US006994577B2

(12) United States Patent
Margulis et al.

(10) Patent No.: US 6,994,577 B2
(45) Date of Patent: Feb. 7, 2006

(54) PANEL MOUNTED ELECTRICAL CONNECTOR SYSTEM

(75) Inventors: Yan Margulis, Buffalo Grove, IL (US); John S. Luthy, Naperville, IL (US); Karen Samiec, Downers Grove, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/870,373

(22) Filed: Jun. 17, 2004

(65) Prior Publication Data

US 2005/0282421 A1 Dec. 22, 2005

(51) Int. Cl.
*H01R 13/64* (2006.01)

(52) U.S. Cl. ..... 439/247; 439/79; 439/545; 439/567

(58) Field of Classification Search ..... 439/247–248, 439/79, 545–546, 567–569
See application file for complete search history.

(56) References Cited

U.S. PATENT DOCUMENTS

| | | | | |
|---|---|---|---|---|
| 4,647,129 A | | 3/1987 | Kandybowski et al. | 339/64 M |
| 4,761,144 A | | 8/1988 | Hunt, III et al. | 439/545 |
| 5,127,852 A | | 7/1992 | Cravens et al. | 439/545 |
| 5,205,755 A | | 4/1993 | Douty et al. | 439/247 |
| 5,605,150 A | * | 2/1997 | Radons et al. | 600/300 |
| 5,620,329 A | | 4/1997 | Kidd et al. | 439/248 |
| 5,888,093 A | | 3/1999 | Polgar et al. | 439/546 |
| 5,980,313 A | | 11/1999 | Kunishi et al. | 439/545 |
| 6,238,242 B1 | | 5/2001 | Hwang | 439/545 |

* cited by examiner

*Primary Examiner*—Truc Nguyen
(74) *Attorney, Agent, or Firm*—Stephen Z. Weiss

(57) ABSTRACT

An electrical connector system includes a panel having a front face, a rear face, a hole through which a connector can mate with a complementary connecting device at the front face of the panel, and an opening spaced from the hole. A connector includes a dielectric housing insertable into the hole in the panel and mateable with the complementary connecting device at the front face of the panel. The housing mounts a plurality of terminals and is sized smaller than the hole to allow for controlled floating movement of the connector relative to the panel. At least one locking arm projects from the housing and has a locking protrusion for engagement in the opening in the panel to prevent excessive movement of the connector in a direction generally parallel to the panel. The opening is larger than the locking protrusion to allow for said controlled floating movement of the connector relative to the panel. At least one flange projects from the rear face of the panel over a rear portion of the connector housing to prevent excessive movement of the connector in a direction generally perpendicular to and rearwardly of the panel. The terminals have flexibly stiff elongated portions projecting rearwardly of the housing to a fixed support structure for supporting the housing generally centrally in the hole in the panel but allowing said controlled floating movement of the connector relative to the panel.

11 Claims, 3 Drawing Sheets

PANEL MOUNTED ELECTRICAL CONNECTOR SYSTEM

FIELD OF THE INVENTION

This invention generally relates to the art of electrical connectors and, particularly, to a floating panel mounting system for electrical connectors.

BACKGROUND OF THE INVENTION

It is known to provide a variety of systems for mounting an electrical connector on or in a panel, such as at a rear side of a panel. Panel mounted electrical connectors usually include a non-conductive or dielectric housing having a plurality of electrically conductive terminals mounted therein. The housing also includes some form of means for mounting the connector to a panel. The panel mounted connector may be mounted to a rear side of a panel, for instance, and is mateable with other electrical apparatus, such as another connector at a front side of the panel. The other connector, in turn, may be mounted to a second panel, a circuit board, a cable or discrete electrical wires.

Quite often, the mating of a panel mounted electrical connector to another connector or circuit component is carried out under blind mating conditions such that precise alignment of the panel mounted connector with the other connector cannot be assured. Blind mating of panel mounted connectors may occur in a wide variety of applications ranging from computer equipment to automotive applications. Attempts to forcibly blind mate improperly aligned electrical connectors can damage the housings of the connectors, the fragile terminals mounted in the housings or, in some instances, even the panels to which the connectors are mounted. Improper alignment also may prevent complete mating, thereby negatively affecting the quality of the electrical connection.

Various prior art panel mounted electrical connectors have been provided with means for permitting a controlled amount of float between the connector housing and the associated panel to solve the above problems in blind mating of panel mounted connectors. Many such connectors have been fairly complex multi-component structures which may even be manufactured separately from the electrical connector and require assembly and installations. Most other floating mounts for panel mounted connectors do little in centering the connector in its through hole in the panel. The present invention is directed to solving these various problems in such panel mounted connectors.

SUMMARY OF THE INVENTION

An object, therefore, of the invention is to provide a new and improved panel mounted electrical connector system of the character described.

Another object of the invention is provide a new and improved floating panel mounting system for electrical connectors.

In the exemplary embodiment of the invention, an electrical connector system includes a panel having a front face, a rear face, a hole through which a connector can mate with a complementary connecting device at the front face of the panel, and an opening spaced from the hole. A connector includes a dielectric housing insertable into the hole in the panel and mateable with the complementary connecting device at the front face of the panel. The housing mounts a plurality of terminals and is sized smaller than the hole to allow for controlled floating movement of the connector relative to the panel. At least one locking arm projects from the housing and has a locking protrusion for engagement in the opening in the panel to prevent excessive movement of the connector in a direction generally parallel to the panel. The opening is larger than the locking protrusion to allow for said controlled floating movement of the connector relative to the panel. At least one flange projects from the rear face of the panel over a rear portion of the connector housing to prevent excessive movement of the connector in a direction generally perpendicular to and rearwardly of the panel. The terminals have flexibly stiff elongated portions projecting rearwardly of the housing to a fixed support structure for supporting the housing generally centrally in the hole in the panel but allowing said controlled floating movement of the connector relative to the panel.

According to one aspect of the invention, the hole in the panel comprises a recess at an edge of the panel, whereby the connector housing is inserted into the recess in a direction generally parallel to the panel. The flange is generally L-shaped, whereby the rear portion of the connector housing moves within the flange automatically as the connector housing is inserted into the recess generally parallel to the panel. In the disclosed embodiment, the flange is integral with the panel. Specifically, the panel is stamped and formed of sheet metal material, and the L-shaped flange is stamped and formed therefrom.

According to another aspect of the invention, the locking arm is flexible whereby the locking protrusion snaps into the opening automatically as the connector housing is inserted into the recess generally parallel to the panel. Preferably, the locking arm is integral with the connector housing. Specifically, the connector housing is molded of plastic material, and the locking arm is molded integrally therewith.

According to a further aspect of the invention, the flexibly stiff elongated portions of the terminals comprise elongated pin sections of the terminals. The terminals have mating ends forwardly of the pin sections and terminating ends rearwardly of the elongated pin sections. The terminating ends comprise solder tails for connection to a printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
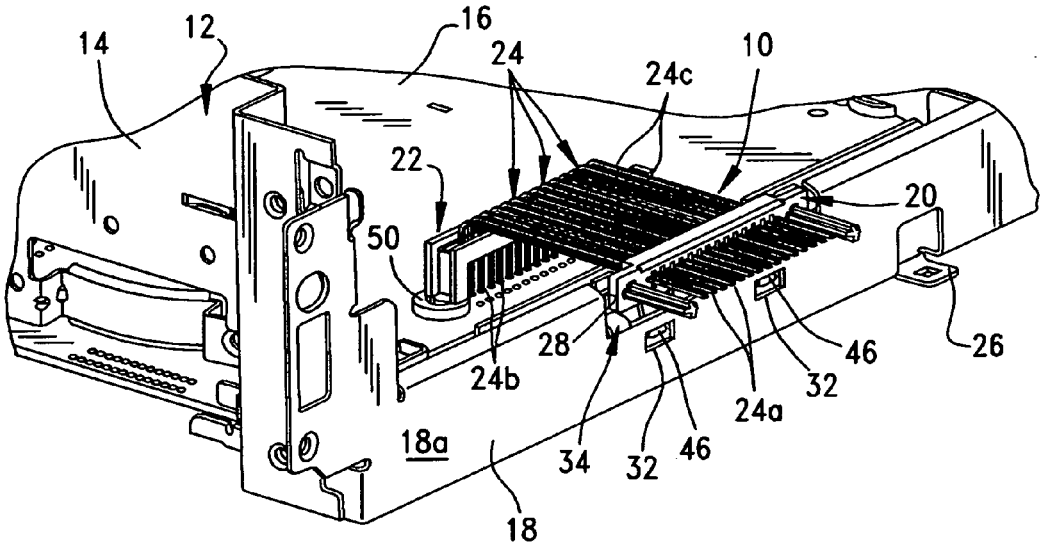
FIG. 1 is a fragmented perspective view of the electrical connector system of the invention mounted in an overall chassis.

Referring to the drawings in greater detail, and first to FIG. 1, the invention is embodied in an electrical connector system, generally designated 10, which is part of an overall chassis, generally designated 12, which is part of an automotive radio assembly. The chassis includes a rear frame 14 which mounts a generally horizontal printed circuit board 16. A front panel 18 is mounted to frame 14 forwardly of the printed circuit board. Connector assembly 10 includes a panel mounted electrical connector, generally designated 20, which is mounted on and through panel 18, along with a header connector, generally designated 22, which is mounted on top of printed circuit board 16. A plurality of terminals, generally designated 24, extend between panel mounted connector 20 and header connector 22.

Figure 2:
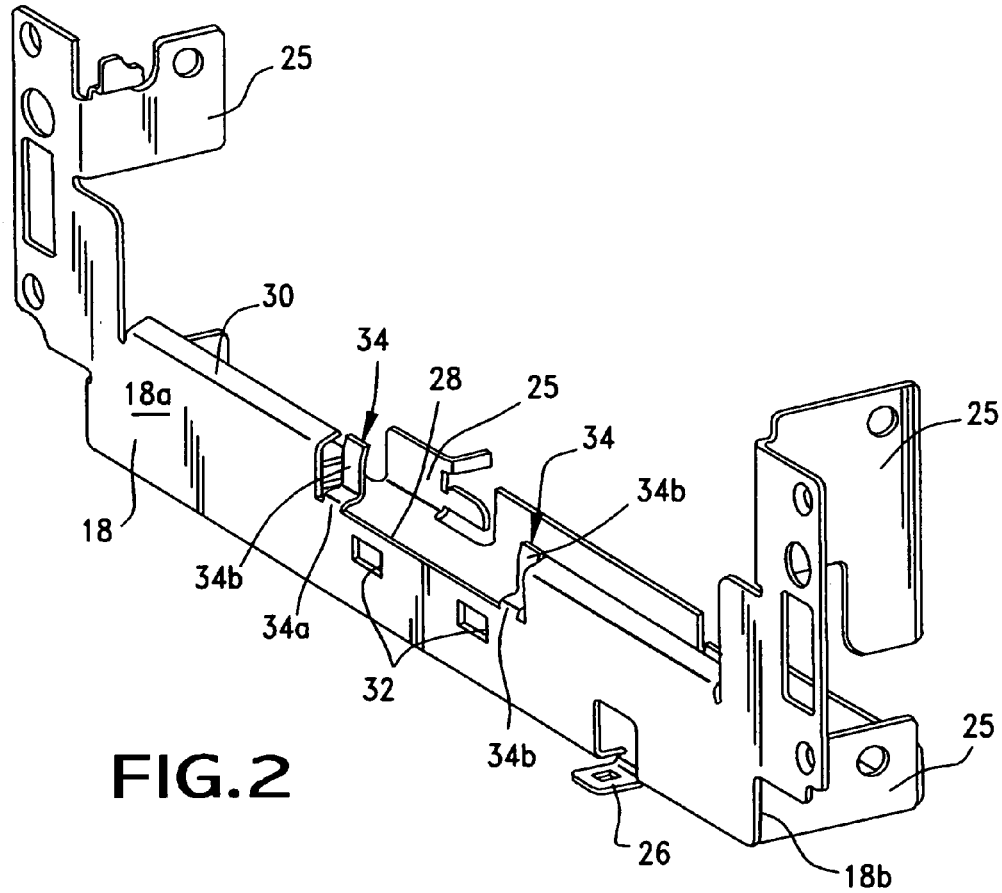
FIG. 2 is a perspective view of the panel which mounts the electrical connector in the overall chassis of FIG. 1.

FIG. 2 shows panel 18 in greater detail. The panel includes a plurality of various mounting flanges 25 which project rearwardly thereof for securing the panel to rear frame 14 (FIG. 1), along with a forwardly projecting flange 26 for securing the panel to an appropriate subjacent support structure. The panel is a one-piece structure which is stamped and formed of sheet metal material. The panel includes a through hole in the form of a recess 28 in an upper edge 30 of the panel and within which the panel mounted connector 20 (FIG. 1) is mounted. A pair of horizontally spaced openings 32 are formed in the panel below recess 28. A pair of L-shaped flanges, generally designated 34, project rearwardly of the panel. Panel 18 has a front face 18*a*, and flanges 34 project rearwardly of a rear face 18*b* of the panel. Each flange 34 has a horizontal, rearwardly projecting leg 34*a* and an upwardly extending leg 34*b* spaced rearwardly of rear face 18*b* of the panel.

Figure 3:
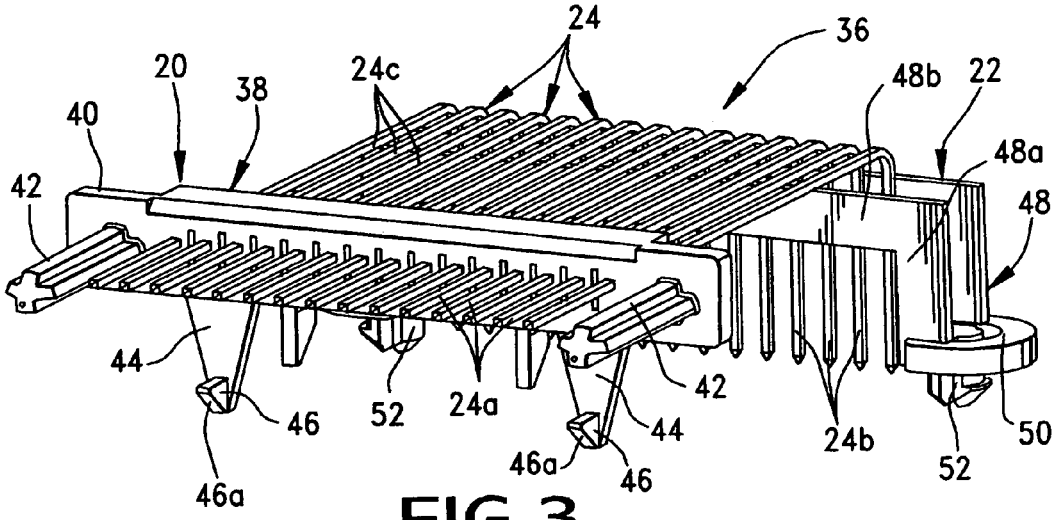
FIG. 3 is a front perspective view of a connector assembly according to the invention.

FIG. 3 shows a connector assembly, generally designated 36, which includes panel mounted connector 20 and header connector 22 joined by terminals 24. As stated above in relation to FIG. 1, connector 20 is mounted in and through panel 18, and header connector 22 is mounted on printed circuit board 16.

Panel mounted connector 20 (FIG. 3) includes a dielectric housing, generally designated 38, which includes a transverse flange 40 which is positionable within recess 28 of panel 18. A pair of guide posts 42 project forwardly of the housing at opposite ends thereof for insertion into a pair of guide holes in a complementary connecting device (not shown) which is mateable with connector 20 at front face 18*a* of panel 18. A pair of locking arms 44 project downwardly from the housing, and each locking arm has a forwardly projecting locking protrusion 46 which has a chamfered or angled front surface 46*a*. Housing 38, including transverse flange 40, guide posts 42 and locking arms 44, is a one-piece structure which may be molded of dielectric plastic material.

Header connector 22 of connector assembly 36 includes an inverted U-shaped housing, generally designated 48, which defines a pair of vertical leg portions 48*a* joined by a horizontal cross portion 48*b*. A horizontal flange 50 is formed at the bottom of each leg portion 48*a* for abutting the top of printed circuit board 16 as seen in FIG. 1. A bifurcated mounting post 52 projects downwardly from each flange 50 for insertion into an appropriate mounting hole in the printed circuit board to fix header connector 22 to the board.

Each terminal 24 of connector assembly 36 (FIG. 3) is generally L-shaped to include a mating end 24*a* which projects forwardly through housing 38 of panel mounted connector 20, along with a terminating end 24*b* which projects downwardly through cross portion 48*b* of housing 48 of header connector 22. Mating ends 24*a* are inserted into appropriate sockets of appropriate terminals of the complementary mating connecting device. Terminating ends 24*b* comprise solder tails for insertion into appropriate holes in printed circuit board 16 and for connection to appropriate circuit traces on the board and/or in the holes. Mating ends 24*a* and terminating ends 24*b* are joined by flexibly stiff elongated pin sections 24*c* which are effective to support housing 38 of panel mounted connector 20 centrally within recess 28 in panel 18. These flexibly stiff elongated portions or pin sections 24*c* are the sole means for floatingly supporting connector 28 centrally within the recess or hole 28 in panel 18. As an example, each elongated portion or pin section 24*c* of each terminal 24 may be fabricated of brass or a phosphor bronze material and may be on the order of 0.025 inch square. This material and the dimensions of the pin sections provide flexibly stiff means for supporting connector 20 and centering the connector within the recess or hole in the panel. No other supporting structures are required. It can be understood that header connector 22, from which pin sections 24*c* project, is rigidly fixed to printed circuit board 16 or some other support structure.

Figure 4:
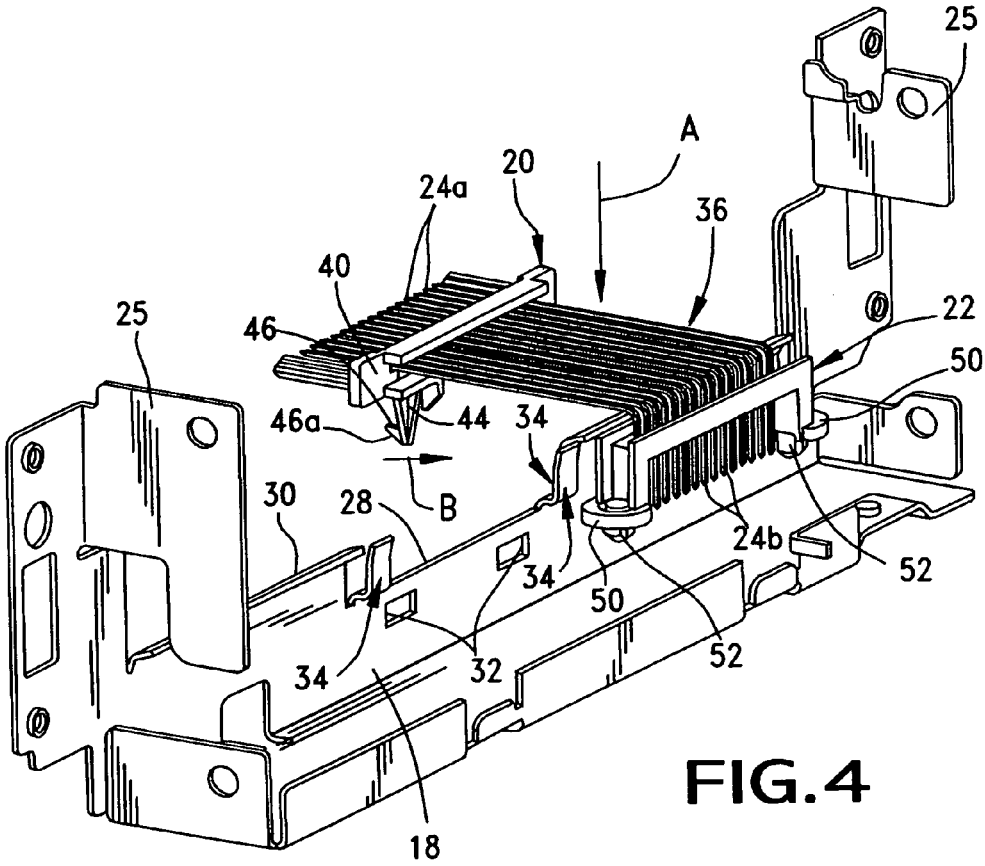
FIG. 4 is a perspective view of the connector assembly of FIG. 3 about to be mounted to the panel of FIG. 2.

FIG. 4 simply shows connector assembly 36 elevated above panel 18 and in the process of being inserted into recess 28 in the direction of arrow □A□ which is generally parallel to panel 18. During insertion or mounting of the connector assembly, mounting posts 52 of header connector 22 will be aligned with the mounting holes in printed circuit board 16. Correspondingly, housing flange 40 of connector 20 will be aligned generally coplanar with panel 18. When the connector assembly is mounted in the direction of arrow □A□ chamfered surfaces 46*a* at the bottom of locking projections 46 on locking arms 48 will engage the top edge of recess 28 to bias the locking arms inwardly in the direction of arrow □B□..

Figure 5:
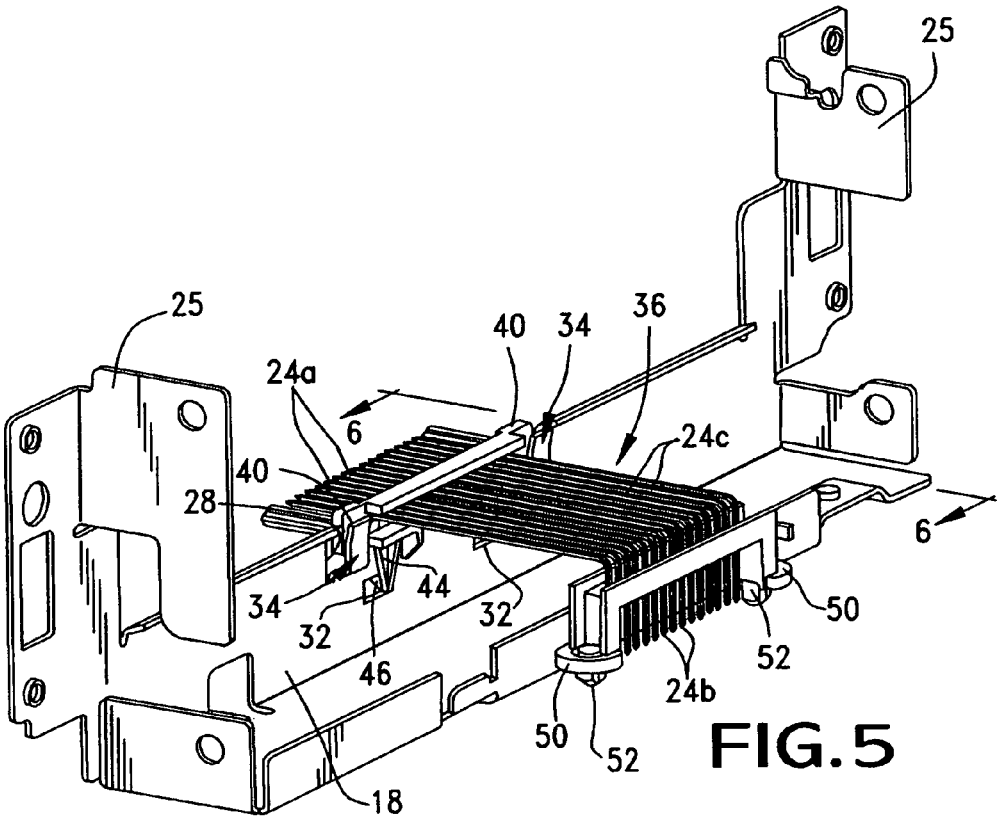
FIG. 5 is a view similar to that of FIG. 4, but with the connector assembly mounted to the panel.
Figure 6:
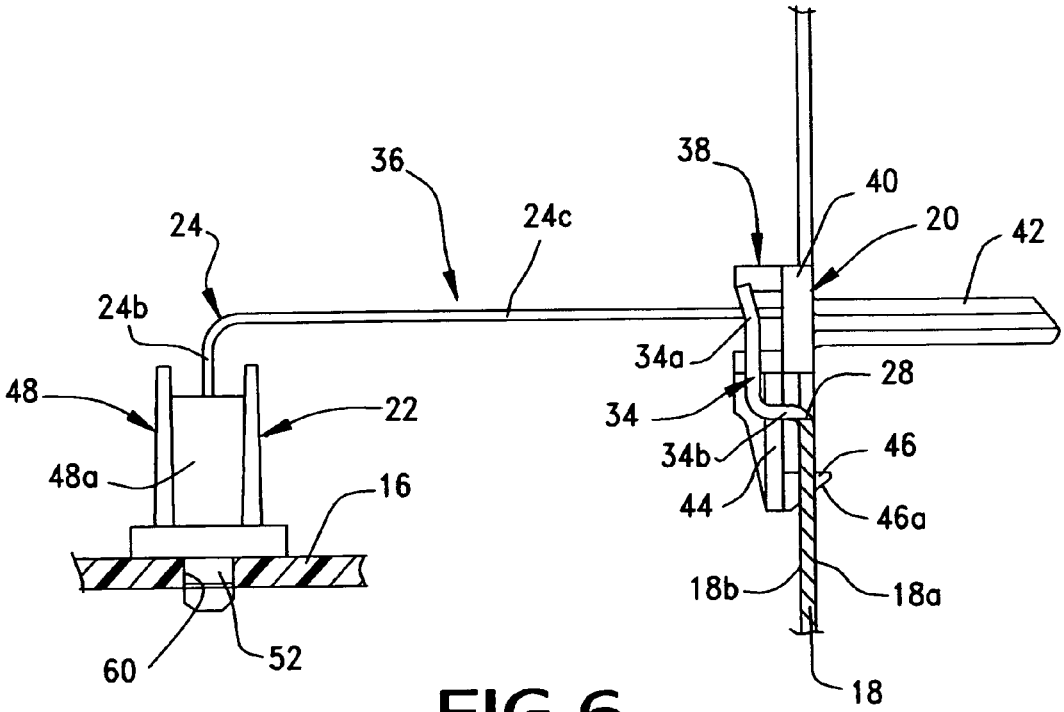
FIG. 6 is an enlarged vertical section taken generally along line 6—6 in FIG. 5.

FIG. 5 shows connector assembly 36 in its fully mounted position, and FIG. 6 shows specific positional details of panel mounted connector 28 relative to panel 18 and header connector 22 relative to printed circuit board 16. It can be seen in FIG. 6 that mounting posts 52 of header connector 22 have been inserted into appropriate mounting holes 60 in the printed circuit board. This rigidly fixes the header connector to the board. The flexibly stiff elongated pin sections 24*c* of terminals 24 support and centrally locate housing 38 and housing flange 40 of connector 20 within the hole or recess 28 in panel 18. During mounting, locking projections 46 at the lower end of locking arms 44 □snap□ into openings 32 in panel 18. It can be seen that housing flange 40 of panel mounted connector 20 is generally coplanar with panel 18, and locking projections 46 prevent connector 20 from being lifted out of recess 28.

It should be understood that panel mounted connector 20 is mounted within recess 28 for controlled floating movement of the connector relative to the panel. Specifically, it can be seen in FIG. 5 that housing flange 40 is smaller than recess 28 to allow for controlled floating movement of the connector relative to the panel, while the flexibly stiff pin sections 24*c* of terminals 24 center the connector housing within the recess. In addition, openings 32 in panel 18 are larger than locking projections 46 to also allow for the floating movement of the connector relative to the panel while the locking projections prevent excessive movement of the connector in a direction generally parallel to the panel.

Finally, it can be seen in FIG. 6 that vertical legs 34*a* of L-shaped flanges 34 are spaced rearwardly of housing flange 40 of the panel-mounted connector 20. These flanges prevent the connector from moving rearwardly an excessive amount which might bend and buckle the elongated, flexibly stiff pin sections 24*c* of the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector system, comprising:

a panel having a front face, a rear face, a hole through which a connector can mate with a complementary connecting device at the front face of the panel, and an opening spaced from the hole;

a connector having a dielectric housing insertable into the hole in the panel and mateable with said complementary connecting device at the front face of the panel, the housing mounting a plurality of terminals and being sized smaller than the hole to allow for controlled floating movement of the connector relative to the panel;

at least one locking arm projecting from the housing and including a locking protrusion for engagement in the opening in the panel to prevent excessive movement of the connector in a direction generally parallel to the panel, the opening being larger than the locking protrusion to allow for said controlled floating movement of the connector relative to the panel;

at least one flange projecting from the rear face of the panel over a rear portion of the connector housing to prevent excessive movement of the connector in a direction generally perpendicular to and rearwardly of the panel; and said terminals having flexible elongated portions projecting rearwardly of the housing to a fixed support structure for supporting the housing generally centrally in the hole in the panel but allowing said controlled floating movement of the connector relative to the panel.

2. The electrical connector system of claim 1 wherein said hole in the panel comprises a recess in an edge of the panel whereby the connector housing is inserted into the recess in a direction generally parallel to the panel.

3. The electrical connector system of claim 2 wherein said flange is generally L-shaped whereby said rear portion of the connector housing moves within the flange automatically as the connector housing is inserted into the recess generally parallel to the panel.

4. The electrical connector system of claim 3 wherein said L-shaped flange is integral with the panel.

5. The electrical connector system of claim 4 wherein said panel is stamped and formed of sheet metal material, and the L-shaped flange is stamped and formed therefrom.

6. The electrical connector system of claim 2 wherein said locking arm is flexible whereby said locking protrusion snaps into said opening automatically as the connector housing is inserted into the recess generally parallel to the panel.

7. The electrical connector system of claim 6 wherein said locking arm is integral with the connector housing.

8. The electrical connector system of claim 7 wherein said connector housing is molded of plastic material, and the locking arm is molded integrally therewith.

9. The electrical connector system of claim 1 wherein said flexible elongated portions of the terminals comprise elongated pin sections of the terminals.

10. The electrical connector system of claim 9 wherein said terminals have mating ends forwardly of said elongated pin sections and terminating ends rearwardly of the elongated pin sections.

11. The electrical connector system of claim 10 wherein said terminating ends of the terminals comprise solder tails for connection to a printed circuit board.

* * * * *